US005414419A

United States Patent [19]

Schwendeman et al.

[11] Patent Number: 5,414,419

[45] Date of Patent: May 9, 1995

[54] BATTERY SAVING METHOD FOR SELECTIVE CALL RECEIVERS

[75] Inventors: Robert J. Schwendeman, Pompano Beach; Leon Jasinski, Ft. Lauderdale; William J. Kuznicki, Coral Springs, all of Fla.

[73] Assignee: Motorola, Inc., Schaumburg, Ill.

[21] Appl. No.: 222,561

[22] Filed: Apr. 4, 1994

Related U.S. Application Data

[63] Continuation of Ser. No. 823,037, Jan. 13, 1992, abandoned, which is a continuation of Ser. No. 445,211, Dec. 4, 1989, abandoned.

[51] Int. Cl.[6] ..... G08B 5/22

[52] U.S. Cl. ..... 340/825.44; 340/825.47

[58] Field of Search ..... 340/825.44, 825.47, 340/825.21, 825.2, 311.1; 455/38.3, 343; 379/56, 57

[56] References Cited

U.S. PATENT DOCUMENTS

| | | | |
|---|---|---|---|
| 4,086,537 | 4/1978 | Asakawa et al. | 325/478 |
| 4,353,065 | 10/1982 | Mori | 340/825.44 |
| 4,383,257 | 5/1983 | Giallanza et al. | 340/825.47 |
| 4,449,248 | 5/1984 | Leslie et al. | 455/38 |
| 4,506,262 | 3/1985 | Vance et al. | 340/825.44 |
| 4,554,665 | 11/1985 | Beesley | 371/55 |
| 4,704,608 | 11/1987 | Sato et al. | 340/825.44 |
| 4,706,272 | 11/1987 | Nishimura et al. | 340/825.44 |
| 4,713,808 | 12/1987 | Gaskill et al. | 340/825.44 |
| 4,734,694 | 3/1988 | Umetsu et al. | 340/825.47 |
| 4,745,408 | 5/1988 | Nagata et al. | 340/825.44 |
| 4,804,954 | 2/1989 | Macnak et al. | 340/825.44 |
| 4,818,987 | 4/1989 | Ide et al. | 340/825.47 |
| 4,845,491 | 7/1989 | Fascenda et al. | 340/825.47 |
| 4,860,003 | 8/1989 | DeLuca et al. | 340/825.44 |

FOREIGN PATENT DOCUMENTS

| | | | |
|---|---|---|---|
| 2110850 | 6/1983 | United Kingdom | 379/57 |

*Primary Examiner*—Donald J. Yusko
*Assistant Examiner*—Edwin C. Holloway, III
*Attorney, Agent, or Firm*—D. Andrew Floam

[57] ABSTRACT

A method is provided for signalling wherein one or more of a group of selective call receivers periodically synchronize to a portion of a received signal and determine whether an indicator indicating the presence of information for any of the group of selective call receivers reside within the received signal. If so, the selective call receivers determine whether other portions of the received signal contain information designated for them. Otherwise, if the indicator is not present, the selective call receivers conserve an energy source.

10 Claims, 3 Drawing Sheets

BATTERY SAVING METHOD FOR SELECTIVE CALL RECEIVERS

This is a file wrapper continuation of prior application Ser. No. 07/823,037 filed on Jan. 13, 1992 abandoned, which is a continuation of Ser. No. 07/445,211 filed on Dec. 4, 1989 by Schwendeman et al. for "Battery Saving Method for Selective Call Receivers", abandoned.

FIELD OF THE INVENTION

This invention relates generally to selective call receivers such as pagers and, more specifically, to a method of signalling therefore.

BACKGROUND OF THE INVENTION

Portable selective call receivers (SCR's) such as pagers typically employ a battery for supplying necessary circuit power. The energy capacity of the battery is conserved by periodically turning off power to certain portions of the SCR circuitry. Specifically, the receiver portion of a pager is usually turned off during times when it is known that a message will not be sent.

In a known paging signalling format, data, transmitted to the pagers in a system, includes a series of frames (the total number of frames being fixed). The battery is conserved by assigning each pager to a specific frame in the series. In this scheme, a pager's receiver can be left "off" for all frames except the pager's assigned frame. However, for pager users that require immediate receipt of sent messages (quick-response users), this method may result in an unacceptable delay. In order to accommodate the quick-response users, there is typically a provision for certain ones of the pagers in use in the system to have the capability to receive messages in any frame. However, this reduces the life of the battery.

Thus, what is needed is a method in a selective call system for allowing quick-response users to receive messages in any frame while still conserving the energy capacity of the battery.

SUMMARY OF THE INVENTION

In carrying out the above and other objects of the invention in one form, there is provided a method for signalling wherein one or more of a group of selective call receivers periodically synchronize to a portion of a received signal and determine whether an indicator indicating the presence of information for any of the group of selective call receivers resides within the received signal. If so, the selective call receivers determine whether other portions of the received signal contain information designated for them. Otherwise, if the indicator is not present, the selective call receivers conserve an energy source.

DETAILED DESCRIPTION OF THE INVENTION

Figure 1:
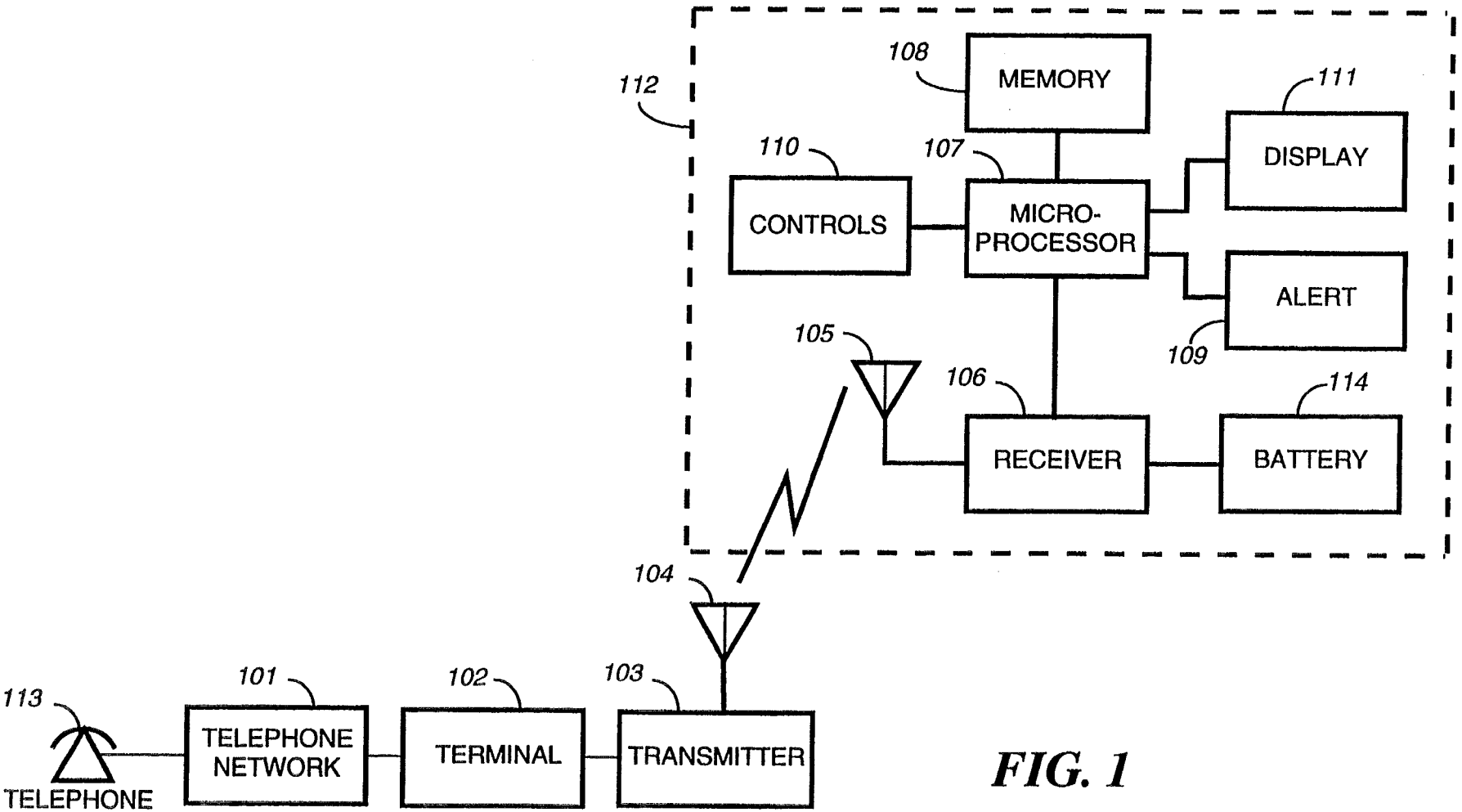
FIG. 1 is a block diagram of a convention selective call system suitable for use with the present invention.

Referring to FIG. 1, a block diagram of a conventional selective call system comprises a telephone 113 from which selective calls comprising digital data are originated and relayed to a public or private telephone network 101. Alternatively, the telephone 113 could comprise another type of data entry device such as an alphanumeric keyboard. Typically, each selective call comprises: (a) a digital code corresponding to the address of a particular selective call receiver (SCR) in the system and, optionally, (b) digital data representing a message. The selective call data is then forwarded to a terminal 102, where it is formatted and organized in a predetermined manner and applied to a transmitter 103 as modulation on a radio frequency signal which is sent over the air through an antenna 104.

A typical SCR 112 receives the modulated radio frequency signal from the air through an antenna 105. This signal is conducted to a receiver 106, where the digital data modulation is recovered and provided to a microprocessor 107. The address portion of the received digital data is compared to one or more addresses stored in a memory 108. If there is a match, the message portion of the digital data is stored in the memory 108, and an alert 109 is activated to inform the SCR user of a received call, and the stored message may then be displayed on a display 111 either automatically or by actuation of one or more controls 110. When the SCR is not receiving data, the microprocessor 107 generally turns the receiver 106 on and off periodically for the purpose of conserving the energy capacity of an energy source (a battery 114). During the "on" portion of the cycle, the receiver 106 checks for the presence of a synchronizing signal transmitted by the terminal 102, the transmitter 103, and the antenna 104. The synchronizing signal, the purpose of which is to synchronize the timing of the data transmission with the reception of the data by each SCR in the system, precedes the transmission of a group of selective calls. Although only one SCR 112 is shown in FIG. 1, the selective call system typically comprises a plurality of such SCR's.

Figure 2:
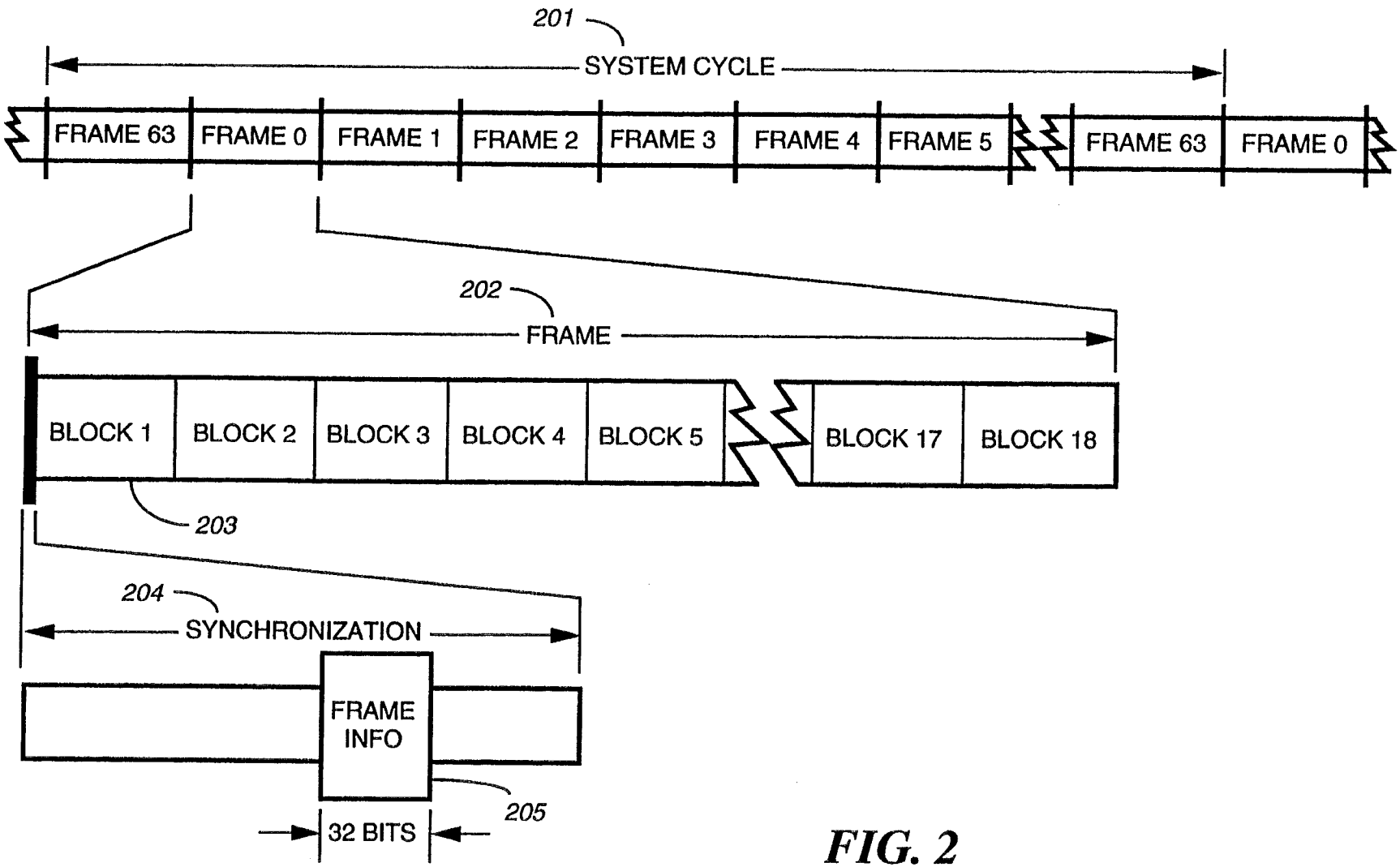
FIG. 2 is a diagram of the signalling format according to the present invention.

Referring to FIG. 2, a diagram of the signalling format of the present invention as sent over the air by the transmitter 103 and antenna 104 comprises a system cycle 201 which includes a predetermined number of frames, where the predetermined number may be 64 (frames 0 through 63) or a different number. Each frame, for example, frame 0 (202), comprises a synchronization portion 204 and a predetermined number of data blocks such as block 1 (203). According to the invention, the synchronization portion 204 comprises a frame information portion 205.

In a first aspect of the invention, certain ones of the SCR's in the system that require immediate receipt of originated calls comprise a first group of SCR's (hereafter referred to as quick-response users) that can receive a selective call in any of the predetermined number of frames. In order to maximize conservation of the battery 114 in the quick-response users, each frame information portion 205 is formatted to indicate whether the frame contains information comprising quick-response user selective calls. This formatting may comprise a specific bit or bits within the frame information 205 that are transmitted in a particular state (zero or one) when quick-response user selective calls are present, and are transmitted in a different state when no quick-response user selective calls are present. An indicator is thus provided to cause the quick-response user SCR's to either leave the receiver 106 "on" for a sufficient portion of the frame for receiving information, or turn the receiver 106 "off" immediately after the frame information 205 to conserve the battery 114.

In a second aspect of the invention, certain ones of the SCR's in the system that receive, on average, a small number of selective calls during a given time form a second group (hereafter referred to as light users) that receive selective calls only within a specific block or blocks (such as block one, 203) of each frame. For these light users, the frame information 205 comprises a specific bit or bits to indicate whether the frame contains any light-user selective calls. The bit or bits are transmitted in a particular state (zero or one) when light-user selective calls are present, and are transmitted in a different state when no light-user selective calls are present. An indicator is thus provided to cause the light-user SCR's to either leave the receiver 106 "on" for a sufficient portion of the specific block(s) to be prepared to receive information, or turn the receiver 106 "off" immediately after the frame information 205 to conserve the battery 114.

In a third aspect of the present invention, aspect one and aspect two are effectively combined to allow both quick-response user and light user selective calls to reside in the same frame. In the third aspect, the frame information portion 205 comprises an indicator that, for the corresponding frame, indicates either: (a) the presence of quick-response user and light user selective calls, (b) the presence of quick-response selective calls only, (c) the presence of light user selective calls only, or (d) the presence of neither quick-response user nor light user selective calls.

Figure 3:
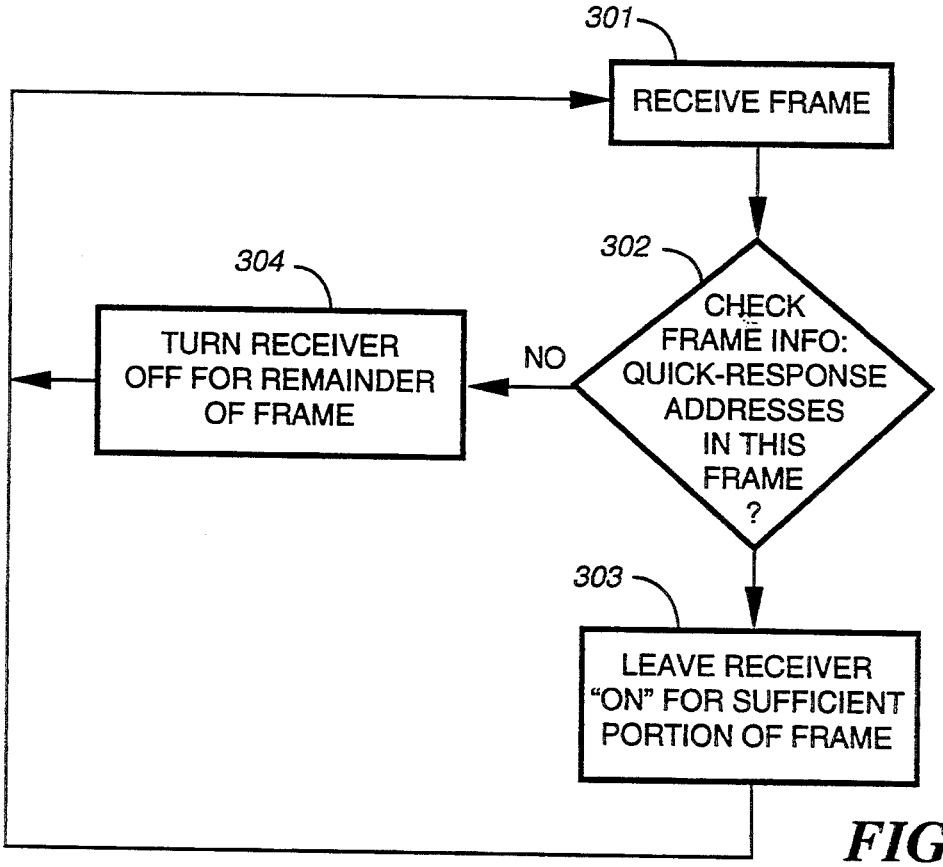
FIG. 3 is a flow diagram of a first aspect of the present invention.

Referring to FIG. 3, a flow diagram of the process of the first aspect comprises receiving a frame, step 301. If, in step 302, the frame information for the frame indicates that there are quick-response user addresses in the frame, the receiver 106 is left "on" for a sufficient portion of the frame in order to receive information which may comprise addresses and messages, step 303. The process then returns to step 301 to receive the next frame.

Referring again to step 302, if the frame information for the frame indicates that there are no quick-response user addresses in the frame, the receiver is turned off for the remainder of the frame, step 304, and the process returns to step 301.

Figure 4:
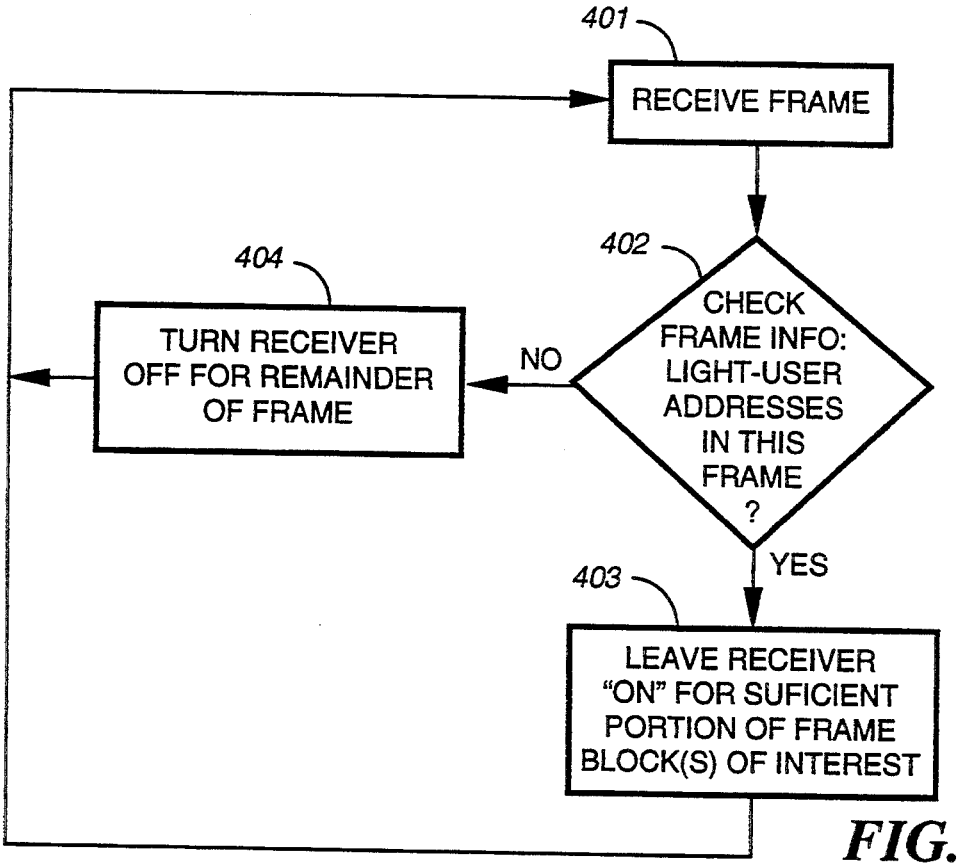
FIG. 4 is a flow diagram of a second aspect of the present invention.

Referring to FIG. 4, a flow diagram of the process of the second aspect comprises receiving a frame, step 401. If, in step 402, the frame information for the frame indicates that there are light-user addresses in the frame, the receiver 106 is left "on" for a sufficient portion of the predetermined specific blocks of the frame in order to receive information which may comprise addresses and messages. The process then returns to step 401 to receive the next frame.

Referring again to step 402, if the frame information for the frame indicates that there are no light-user addresses in the frame, the receiver is turned off for the remainder of the frame, step 404, and the process then returns to step 401.

We claim:

1. A method for controlling operation of a plurality of selective call receivers each of which comprises a receiver portion, responsive to a signal comprising a plurality of frames, each frame comprising a synchronizing portion and a plurality of blocks following the synchronizing portion containing messages, the method comprising steps of:

designating a first group of selective call receivers for receiving messages in any of the plurality of frames;

designating a second group of selective call receivers for receiving messages only in at least one particular block of each frame;

inserting a frame information indicator in the synchronizing portion for each frame;

the first and second groups of selective call receivers activating their receiver portions during the synchronizing portion for each frame; and assigning values to said frame information indicator for indicating to the first and second groups of selective call receivers whether a message designated for their reception is contained in an associated frame and whether the first and/or second group of selective call receivers should maintain their receiver portions powered-up for at least a portion of the associated frame.

2. The method of claim 1, wherein the step of assigning comprises:

assigning a first value to said frame information indicator for indicating to the first group of selective call receivers that a message designated for their reception is contained in the associated frame and for triggering the first group of selective call receivers to maintain their receiver portions powered-up for the duration of the associated frame, and for indicating to the second group of selective call receivers that no message designated for their reception is contained in the associated frame and for triggering the second group of selective call receivers to power-down their receiver portions for the remainder of the frame.

3. The method of claim 2, wherein the step of assigning comprises:

assigning a second value to said frame information indicator for indicating to the first group of selective call receivers that no message designated for their reception is contained in the associated frame and for triggering the first group of selective call receivers to power-down their receiver portions for the duration of the associated frame, and for indicating to the second group of selective call receivers that a message designated for their reception is contained in the at least one particular block of the associated frame and for triggering the second group of selective call receivers to power-up their receiver portions at the at least one block of the associated frame.

4. The method of claim 3, wherein the step of assigning comprises:

assigning a third value to said frame information indicator for indicating to the first and second group of selective call receivers that a message designated for their reception is contained in the associated frame and for triggering the first group of selective call receivers to maintain their receiver portion powered-up for the duration of the frame, and for triggering the second group of selective call receivers to power-up their receiver portions at the at least one particular block of the associated frame.

5. The method of claim 4, wherein the step of assigning comprises the step of:

assigning a fourth value to said frame information indicator for indicating to the first and second group of selective call receivers that no message designated for their reception is contained in the associated frame and for triggering the first and second group of selective call receivers to power-down their receiver portions for the duration of the associated frame.

6. A selective call communication system comprising:

a selective call station including a selective call terminal for receiving selective call messages and for formatting the selective call messages into a signal comprising a plurality of frames, each frame comprising a synchronizing portion and a plurality of blocks following the synchronizing portion containing messages, a transmitter for transmitting the signal;

a plurality of selective call receivers each comprising a receiver portion for receiving the signal, a first group of selective call receivers for receiving messages in any of the plurality of frames, a second group of selective call receivers for receiving messages only in at least one particular block of each frame, the first and second groups of selective call receivers activating their receiver portions during the synchronizing portion for each frame;

the selective call terminal inserting a frame information indicator in the synchronizing portion for each frame and assigning values to said frame information indicator for indicating to the first and second groups of selective call receivers whether a message designated for their reception is contained in an associated frame and whether the first and/or second group of selective call receivers should maintain their receiver portions powered-up for at least a portion of the associated frame.

7. The system of claim 6, wherein the selective call terminal assigns a first value to said frame information indicator for indicating to the first group of selective call receivers that a message designated for their reception is contained in the associated frame and for triggering the first group of selective call receivers to maintain their receiver portions powered-up for the duration of the associated frame, and for indicating to the second group of selective call receivers that no message designated for their reception is contained in the associated frame and for triggering the second group of selective call receivers to power-down their receiver portions for the remainder of the frame.

8. The system of claim 7, wherein the selective call terminal assigns a second value to said frame information indicator for indicating to the first group of selective call receivers that no message designated for their reception is contained in the associated frame and for triggering the first group of selective call receivers to power-down their receiver portions for the duration of the associated frame, and for indicating to the second group of selective call receivers that a message designated for their reception is contained in the at least one particular block of the associated frame and for triggering the second group of selective call receivers to power-up their receiver portions at the at least one block of the associated frame.

9. The system of claim 8, wherein the selective call terminal assigns a third value to said frame information indicator for indicating to the first and second group of selective call receivers that a message designated for their reception is contained in the associated frame and for triggering the first group of selective call receivers to maintain their receiver portion powered-up for the duration of the frame, and for triggering the second group of selective call receivers to power-up their receiver portions at the at least one particular block of the associated frame.

10. The system of claim 9, wherein the selective call terminal assigns a fourth value to said frame information indicator for indicating to the first and second group of selective call receivers that no message designated for their reception is contained in the associated frame and for triggering the first and second group of selective call receivers to power-down their receiver portions for the duration of the associated frame.

* * * * *